US010378360B2

(12) United States Patent
Carrico

(10) Patent No.: US 10,378,360 B2
(45) Date of Patent: Aug. 13, 2019

(54) FAN ROOT ENDWALL CONTOURING

(71) Applicant: United Technologies Corporation, Hartford, CT (US)

(72) Inventor: Jeff M. Carrico, Middletown, CT (US)

(73) Assignee: UNITED TECHNOLOGIES CORPORATION, Farmington, CT (US)

( * ) Notice: Subject to any disclaimer, the term of this patent is extended or adjusted under 35 U.S.C. 154(b) by 428 days.

(21) Appl. No.: 15/022,836

(22) PCT Filed: Aug. 1, 2014

(86) PCT No.: PCT/US2014/049368
§ 371 (c)(1),
(2) Date: Mar. 17, 2016

(87) PCT Pub. No.: WO2015/041758
PCT Pub. Date: Mar. 26, 2015

(65) Prior Publication Data

US 2016/0230562 A1 Aug. 11, 2016

Related U.S. Application Data

(60) Provisional application No. 61/878,950, filed on Sep. 17, 2013.

(51) Int. Cl.
*F04D 29/32* (2006.01)
*F01D 5/14* (2006.01)
*F04D 29/68* (2006.01)

(52) U.S. Cl.
CPC ..... *F01D 5/143* (2013.01); *F04D 29/321* (2013.01); *F04D 29/329* (2013.01); (Continued)

(58) Field of Classification Search
None
See application file for complete search history.

(56) References Cited

U.S. PATENT DOCUMENTS 5,397,215 A 3/1995 Spear et al.
5,836,744 A 11/1998 Zipps et al.
(Continued)

FOREIGN PATENT DOCUMENTS

EP 2487329 A1 8/2012
WO 2011022111 A2 2/2011
WO 2015195112 A1 12/2015

OTHER PUBLICATIONS

Extended European Search Report dated Jun. 2, 2017 in related EP Patent Application No. 14845929.0, 7 pages.
International Search Report for International Application No. PCT/US2014/049368; dated Nov. 18, 2014.
Written Opinion for International Application No. PCT/US2014/049368; dated Nov. 18, 2014.

*Primary Examiner* — Jason D Shanske
*Assistant Examiner* — Theodore C Ribadeneyra
(74) *Attorney, Agent, or Firm* — Cantor Colburn LLP

(57) ABSTRACT

A turbomachine includes an endwall with a plurality of circumferentially spaced apart, radially extending blades extending from the endwall. A first one of the blades defines a pressure surface of a flow channel, a second one of the blades defines a suction surface of the flow channel, and the endwall defines an inner surface of the flow channel. The endwall includes a radially raised portion that is raised proximate the suction surface, and a radially depressed portion downstream of the raised portion.

16 Claims, 4 Drawing Sheets

(52) U.S. Cl.
CPC ..... *F04D 29/681* (2013.01); *F01D 5/145* (2013.01); *F05D 2220/36* (2013.01); *F05D 2240/306* (2013.01); *F05D 2240/80* (2013.01); *F05D 2250/70* (2013.01)

(56) References Cited

U.S. PATENT DOCUMENTS

| | | | | |
|---|---|---|---|---|
| 6,561,761 | B1 | 5/2003 | Decker et al. | |
| 7,249,933 | B2 | 7/2007 | Lee et al. | |
| 2006/0140768 | A1* | 6/2006 | Tam | F01D 5/143 416/193 A |
| 2007/0059177 | A1* | 3/2007 | Harvey | F01D 5/143 416/179 |
| 2009/0191049 | A1 | 7/2009 | Aubin et al. | |
| 2010/0158696 | A1* | 6/2010 | Pandey | F01D 5/143 416/243 |
| 2010/0166558 | A1* | 7/2010 | Siden | F01D 5/145 416/193 R |
| 2011/0044818 | A1* | 2/2011 | Kuhne | F01D 5/143 416/212 A |
| 2012/0201688 | A1* | 8/2012 | Mahle | F01D 5/143 416/235 |
| 2013/0108433 | A1* | 5/2013 | Green | F01D 5/141 415/208.2 |
| 2013/0136621 | A1* | 5/2013 | Wunderer | F01D 5/145 416/243 |

* cited by examiner 100
106
114
102
12
104
112
110
108
0.12
0.08
0.04
0
-0.04
-0.08
-0.12
-0.16
-0.20
-0.24
-0.28
-0.32
-0.36
-0.40
-0.44
-0.48
-0.52
-0.56
-0.60
-0.64
-0.68
-0.72
-0.76
-0.80
-0.84
-0.88
-0.92
-0.96
-1.00
-1.04
-1.08
-1.12
-1.16
-1.20
-1.24
-1.28
-1.32
-1.36
-1.40
-1.44
-1.48
-1.52
-1.56
-1.60

FAN ROOT ENDWALL CONTOURING

RELATED APPLICATIONS

This application claims the benefit of and priority to U.S. Provisional Patent Application No. 61/878,950 filed Sep. 17, 2013, the contents of which are incorporated herein by reference in their entirety.

STATEMENT REGARDING FEDERALLY SPONSORED RESEARCH OR DEVELOPMENT

This invention was made with government support under contract number DTFAWA-10-C-00041 awarded by the FAA. The government has certain rights in the invention.

BACKGROUND OF THE INVENTION

1. Field of the Invention

The present disclosure relates to fans, and more particularly to turbofans for gas turbine engines, for example.

2. Description of Related Art

A gas turbine engine typically includes a compressor section, a combustor section, and a turbine section. In the case of a turbofan, the engine also includes a fan section. Air entering the compressor section is compressed and delivered into the combustion section where it is mixed with fuel and ignited to generate a high-speed exhaust gas flow. The high-speed exhaust gas flow expands through the turbine section to drive the compressor and the fan section.

The fan section drives air through a core passage and a bypass passage. The ratio of flow through the bypass passage versus through the core (compressor and turbine) is called the bypass ratio. There is a trend toward larger and larger bypass ratios. For example, in a geared turbo fan (GTF) engine, a gearing system is used to connect the driving shaft to the fan section, so the fan can rotate at a different speed from the turbine driving the fan. One aspect of this type of engine is a larger bypass ratio than previous turbofan engines. As bypass ratio increases, the flow efficiency through the fan and bypass passage is increasingly becoming a key factor in overall engine performance.

Such conventional methods and systems have generally been considered satisfactory for their intended purpose. However, there is still a need in the art for systems and methods that allow for improved flow efficiency in fans and bypass passages. The present disclosure provides a solution for these problems.

SUMMARY OF THE INVENTION

A turbomachine includes an endwall with a plurality of circumferentially spaced apart, radially extending blades extending from the endwall. A first one of the blades defines a pressure surface of a flow channel, a second one of the blades defines a suction surface of the flow channel, and the endwall defines an inner surface of the flow channel. The endwall includes a radially raised portion that is raised proximate the suction surface, and a radially depressed portion downstream of the raised portion.

The raised portion of the endwall can be proximate a leading edge of the blade defining the suction surface, and can be closer to the suction surface than to the pressure surface. The endwall can include a radially neutral portion between the apex of the raised portion and the pressure surface. The neutral portion can be substantially neutral in radial elevation, extending from the pressure surface to a midway point between the pressure surface and the suction surface circumferentially.

The depressed portion of the endwall can extend circumferentially from the pressure surface to the suction surface. The depressed portion can extend axially through the flow channel from an outlet of the channel defined by trailing edges of the blades to a point over half of the way upstream toward an inlet defined by leading edges of the blades.

A fan assembly for a turbofan can include an endwall and blades as recited above, wherein there is a flow channel as described above defined between each pair of circumferentially adjacent blades.

A fan blade for a turbofan can include a blade portion and a pair of opposed endwall portions extending laterally from the blade portion, wherein each endwall portion is configured to form an endwall with a circumferentially adjacent endwall portion, wherein the endwall is as described above. It is also contemplated that an endwall segment body, e.g., separate from a fan blade, can define an inner surface of a respective flow channel, wherein the inner surface of the endwall segment body is as described above.

These and other features of the systems and methods of the subject disclosure will become more readily apparent to those skilled in the art from the following detailed description of the preferred embodiments taken in conjunction with the drawings.

BRIEF DESCRIPTION OF THE DRAWINGS

So that those skilled in the art to which the subject disclosure appertains will readily understand how to make and use the devices and methods of the subject disclosure without undue experimentation, preferred embodiments thereof will be described in detail herein below with reference to certain figures, wherein.

DETAILED DESCRIPTION OF THE PREFERRED EMBODIMENTS

Figure 1:
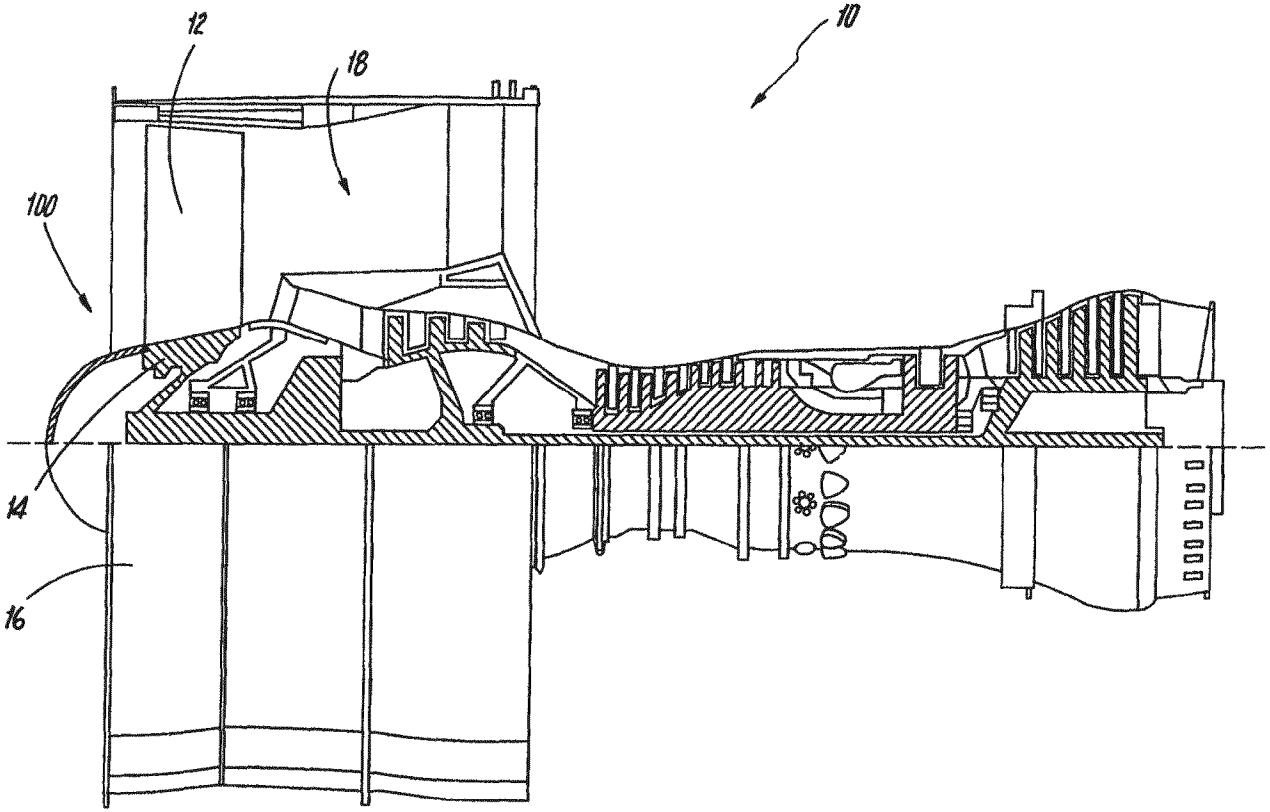
FIG. 1 is a cross-sectional side elevation view of an exemplary embodiment of a gas turbine engine constructed in accordance with the present disclosure, showing the fan assembly.

Reference will now be made to the drawings wherein like reference numerals identify similar structural features or aspects of the subject disclosure. For purposes of explanation and illustration, and not limitation, a partial view of an exemplary embodiment of a gas turbine engine in accordance with the disclosure is shown in FIG. 1 and is designated generally by reference character 10. Other embodiments of gas turbine engines in accordance with the disclosure, or aspects thereof, are provided in FIGS. 2-3, as will be described. The systems and methods described herein can be used to improve flow through fan sections in turbofan engines, for example.

Gas turbine engine 10 is a turbofan engine and includes a fan section 16, having an endwall portion 14 and fan blades 12. Other sections of gas turbine engine 10 not described herein generally are understood by those skilled in the art. The endwall portion 14 and blades 12 form an axial turbomachine, namely a fan assembly, herein referred to as fan 100, for driving flow through the bypass passage 18 of engine 10.

Figure 2:
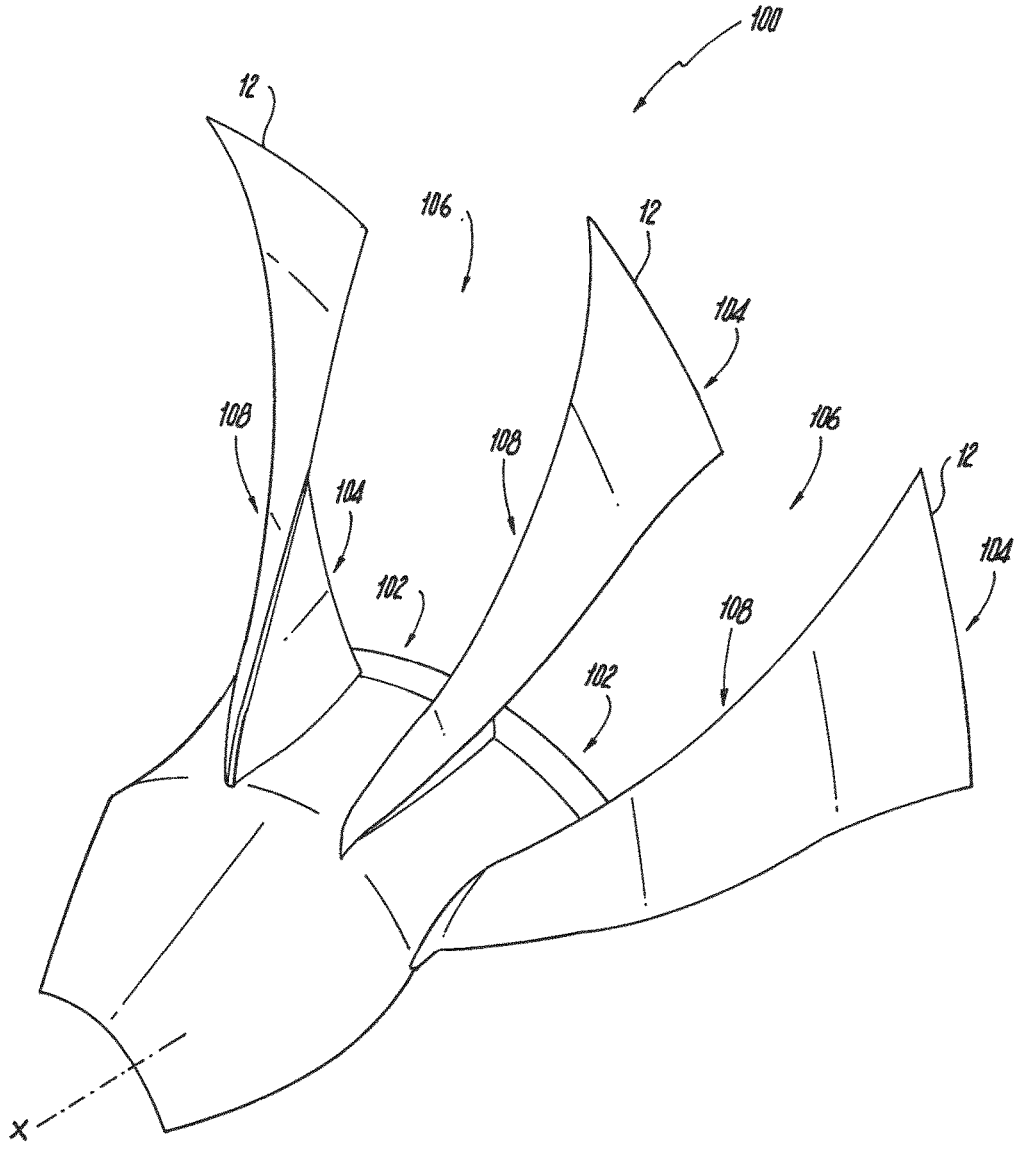
FIG. 2 is a perspective view of a portion of the fan assembly of FIG. 1, showing the flow channels between circumferentially adjacent fan blades.

Referring now to FIG. 2, fan 100 includes an endwall 102 and the plurality of circumferentially spaced apart, radially extending blades 12 extend from endwall 102. Each of the blades 12 defines a pressure surface 104 of a flow channel 106. Each of the blades 12 also defines a suction surface 108 of the respective flow channel 106, wherein the suction surface 108 of each blade 12 is opposite the pressure surface 104 thereof. Each suction surface 108 is opposed to a respective pressure surface 104 across a respective flow channel 106. Endwall 102 defines an inner surface of each flow channel 106. In FIG. 2, only two flow channels 106 and the three respective blades 12 are shown for sake of clarity, however those skilled in the art will readily appreciate that the circumferential pattern continues all the way around fan 100, and that any suitable number of blades and channels can be used without departing from the scope of this disclosure.

Figure 3:
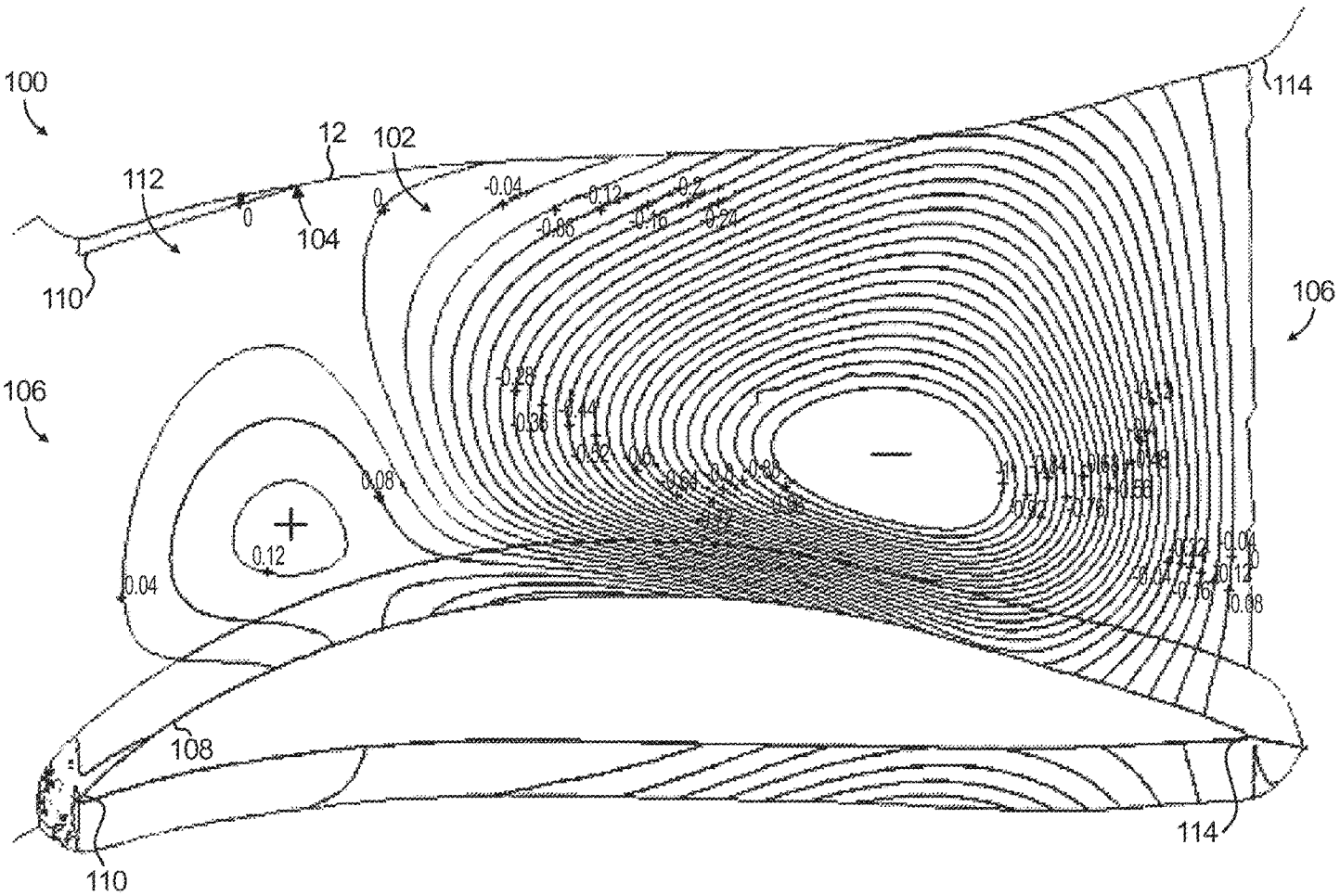
FIG. 3 is a schematic plan view of the endwall of one of the flow channels of FIG. 2, showing the elevation contours of the radially raised and depressed portions of the endwall.

Referring now to FIG. 3, endwall 102 includes a radially raised portion, the apex of which is marked in FIG. 3 with a plus sign, that is raised proximate suction surface 108, and a radially depressed portion, the apex of which is marked with a minus sign in FIG. 3, downstream of the raised portion. The radially depressed portion having a majority located downstream of a majority of the raised portion. The raised portion of endwall 102 is proximate leading edge 110 of the blade 12 defining the respective suction surface 108, and is closer to the suction surface 108 than to the pressure surface 104. Endwall 102 includes a radially neutral portion 112 between the apex of the raised portion and the respective pressure surface 104. Neutral portion 112 is substantially neutral in radial elevation, extending from the respective pressure surface 104 to a midway point between the pressure surface 104 and the suction surface 108 circumferentially. The neutral portion 112 is neutral in the sense that it conforms to the shape of the nominal axisymmetric flow path, an example of which is defined in U.S. Pat. No. 5,397,215 which is incorporated by reference herein in its entirety. The numerical values provided on the contours of FIG. 3 are normalized relative to the maximum depth of the depressed portion. The normalized depths in FIG. 3 are relative to the nominal axisymmetric flow path.

The depressed portion of endwall 102 extends circumferentially from the pressure surface 104 to the suction surface 108. The depressed portion can extend axially through the respective flow channel 106 from an outlet of the channel defined by trailing edges 114 of the blades 12 to a point over half of the way upstream toward an inlet defined by leading edges 110 of the blades 12. While FIG. 3 only shows the contouring of one endwall portion of one channel 106, those skilled in the art will readily appreciate that each respective endwall portion for each channel 106 of fan 100 can be contoured in the same manner. Those skilled in the art will readily appreciate that variations of the pattern shown in FIG. 3, and any suitable scaling of the depths can be used without departing from the scope of this disclosure.

Figure 4:
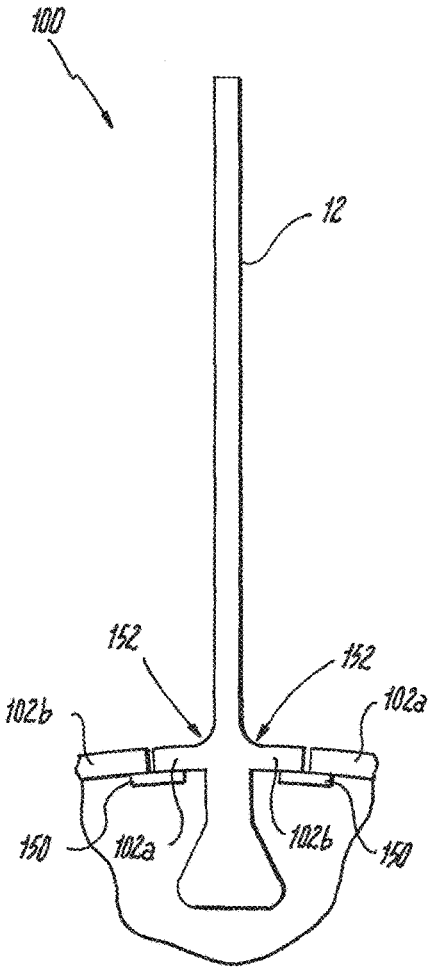
FIG. 4 is a schematic end view of one of the fan blades of FIG. 2, showing the opposed endwall portions extending laterally from the blade portion to form the endwalls between adjacent blades.
Figure 5:
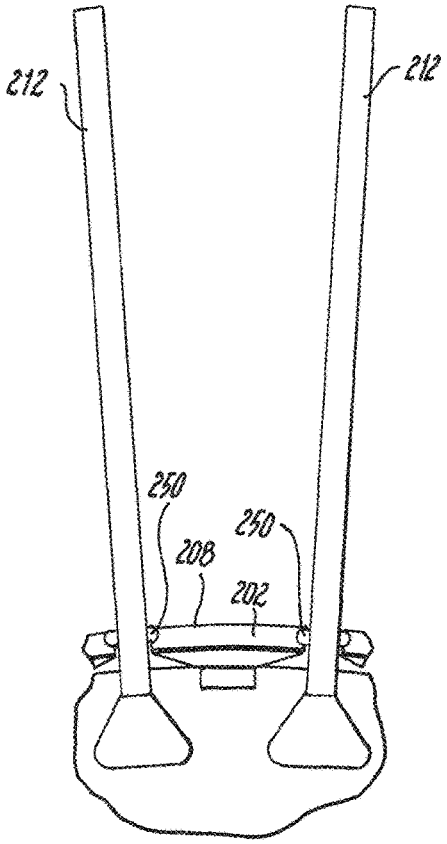
FIG. 5 is a schematic end view of an exemplary embodiment of a fan blade assembly constructed in accordance with the subject disclosure, showing separate endwall segments circumferentially between adjacent fan blades.

With reference now to FIGS. 4 and 5, it is contemplated that the endwall contouring can be provided as an endwall portion that is part of the individual blade, as an endwall portion that is separate from the blade, or any other suitable endwall/blade configuration. For example, FIG. 4 shows one blade 12 with an endwall portion 102*a* and an opposed endwall portion 102*b* extending laterally from the base portion of blade 12. Each endwall portion 102*a* forms an endwall with its adjacent endwall portion 102*b* of the adjacent blade 12. A small gap between adjacent endwall portions 102*a* and 102*b* is sealed by a seal 150. The endwall contours shown in FIG. 3 are formed in the combined surfaces of each matching pair of endwall portions 102*a* and 102*b*. The gap shown between adjacent endwall portions 102*a* and 102*b* in FIG. 4 is exaggerated for sake of clarity. The transition between the main portion of each blade 12 and its endwall portions can include a fillet 152.

In another exemplary embodiment shown in FIG. 5, blades 212 do not include endwall portions. Instead, endwall segments 202 are provided between each adjacent pair of blades 212. Much like endwall portions 102*a* and 102*b* described above, the radially outward surface 208 of the body of each endwall segment 202 includes the contours as shown in FIG. 3. Sealing is provided between the blades 212 and endwall segments 202, e.g., with rubber seals 250.

The endwall contouring described herein can be used to reduce and control endwall vortex rollup coming off of the fan root inner diameter. The non-axisymmetric deflections or contours in the fan root platform generate a static pressure field that impacts the endwall vortex generation. This provides for an improved flow field profile entering the core and neutral or beneficial impact on engine TSFC (thrust specific fuel consumption). FIGS. 4 and 5 show two exemplary endwall configurations, and those skilled in the art will readily appreciate that the contouring disclosed herein can be applied to any other suitable endwall configuration as well.

While shown and described in the exemplary context of a fan assembly, those skilled in the art will readily appreciate that the endwall contouring disclosed herein can readily be applied to compressors, turbines, or any other suitable application without departing from the scope of the invention.

The methods and systems of the present disclosure, as described above and shown in the drawings, provide for endwall contouring with superior properties including improved flow field profile. While the apparatus and methods of the subject disclosure have been shown and described with reference to preferred embodiments, those skilled in the art will readily appreciate that changes and/or modifications may be made thereto without departing from the spirit and scope of the subject disclosure.

What is claimed is:

1. A turbomachine comprising:

an endwall with a plurality of circumferentially spaced apart, radially extending blades extending from the endwall, wherein a first one of the blades defines a pressure surface of a flow channel, a second one of the blades defines a suction surface of the flow channel, and the endwall defines an inner surface of the flow channel, and wherein the endwall includes a radially raised portion that is raised proximate the suction surface, a radially depressed portion having a majority located downstream of a majority of the raised portion, and a radially neutral portion that directly extends from the pressure surface to a midway point between the pressure surface and the suction surface circumferentially, wherein the depressed portion extends axially through the flow channel from an outlet of the channel defined by trailing edges of the blades to a point over half of the way upstream toward an inlet defined by leading edges of the blades.

2. A turbomachine as recited in claim 1, wherein the raised portion of the endwall is proximate a leading edge of the blade defining the suction surface.

3. A turbomachine as recited in claim 1, wherein the apex of the raised portion is closer to the suction surface than to the pressure surface.

4. A turbomachine as recited in claim 3, wherein the radially neutral portion extends between the apex of the raised portion and the pressure surface.

5. A turbomachine as recited in claim 4, wherein the neutral portion is substantially neutral in radial elevation.

6. A turbomachine as recited in claim 1, wherein the depressed portion of the endwall extends circumferentially from the pressure surface to the suction surface.

7. A fan assembly for a turbofan comprising:

a blade portion and a pair of opposed endwall portions extending laterally from the blade portion, wherein each endwall portion is configured to form an endwall with a circumferentially adjacent endwall portion, wherein the endwall defines an inner surface of a flow channel, and wherein the endwall includes a radially raised portion that is raised proximate a suction surface of the flow channel, a radially depressed portion having a majority located downstream of a majority of the raised portion, and a radially neutral portion that directly extends from a pressure surface to a midway point between the pressure surface and the suction surface circumferentially, wherein the depressed portion extends axially through the flow channel from an outlet of the channel defined by trailing edges of adjacent blades to a point over half of the way upstream toward an inlet defined by leading edges of the blades.

8. A fan assembly as recited in claim 7, wherein the raised portion of the endwall is proximate a leading edge of the blade portion defining the respective suction surface.

9. A fan assembly as recited in claim 7, wherein the apex of the raised portion is closer to the respective suction surface than to the respective pressure surface.

10. A fan assembly as recited in claim 9, wherein the radially neutral portion is between the apex of the respective raised portion and the respective pressure surface.

11. A fan assembly as recited in claim 10, wherein the neutral portion is substantially neutral in radial elevation.

12. A fan assembly as recited in claim 7, wherein the depressed portion of the endwall extends circumferentially from the respective pressure surface to the respective suction surface.

13. A fan assembly as recited in claim 7, wherein the radially neutral portion circumferentially extends from proximate a leading edge of the blade portion defining the pressure surface towards an apex of the raise portion.

14. An endwall segment for fan assembly of a turbofan comprising:

an endwall segment body defining an inner surface of a respective flow channel, wherein the inner surface of the endwall segment body includes a radially raised portion that is raised proximate a respective suction surface of the endwall segment body, a radially depressed portion having a majority located downstream of a majority of the raised portion, and a radially neutral portion that directly extends from the respective pressure surface to a midway point between the respective pressure surface and the respective suction surface circumferentially, wherein the depressed portion extends axially from an outlet portion of the endwall segment body to a point over half of the way upstream toward an inlet portion of the endwall segment body opposed to the outlet portion.

15. An endwall segment as recited in claim 14, wherein the radially neutral portion is between the apex of the respective raised portion and a respective pressure surface of the endwall segment body that is opposed to the respective suction surface.

16. An endwall segment as recited in claim 15, wherein the depressed portion of the endwall extends circumferentially from the respective pressure surface to the respective suction surface.

* * * * *